US010233014B2

(12) United States Patent
Nussbaum

(10) Patent No.: US 10,233,014 B2
(45) Date of Patent: Mar. 19, 2019

(54) MILK CRATE

(71) Applicant: ORBIS Corporation, Oconomowoc, WI (US)

(72) Inventor: Robert G. Nussbaum, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 330 days.

(21) Appl. No.: 15/019,642

(22) Filed: Feb. 9, 2016

(65) Prior Publication Data

US 2016/0229586 A1 Aug. 11, 2016

Related U.S. Application Data

(60) Provisional application No. 62/114,176, filed on Feb. 10, 2015.

(51) Int. Cl.

| | |
|---|---|
| ***B65D 75/00*** | (2006.01) |
| ***B65D 85/80*** | (2006.01) |
| ***B65D 1/36*** | (2006.01) |
| ***B65D 21/02*** | (2006.01) |
| ***B65D 71/70*** | (2006.01) |

(52) U.S. Cl.

CPC ..... *B65D 85/80* (2013.01); *B65D 1/36* (2013.01); *B65D 21/0224* (2013.01); *B65D 21/0234* (2013.01); *B65D 71/70* (2013.01)

(58) Field of Classification Search

USPC ..... 206/505, 507, 517, 518, 564; 220/507, 220/4.27

See application file for complete search history.

(56) References Cited

U.S. PATENT DOCUMENTS

| | | | | |
|---|---|---|---|---|
| 2,162,162 | A * | 6/1939 | De Murguiondo | F25C 1/24 217/26.5 |
| 3,191,796 | A * | 6/1965 | Schwartz | B65D 21/045 206/507 |
| 4,838,444 | A * | 6/1989 | Bitel | B65D 1/36 206/518 |
| 5,042,674 | A * | 8/1991 | Ramsay | B65D 21/0219 206/505 |
| 6,702,139 | B2 * | 3/2004 | Bergeron | B65D 1/36 206/521.1 |
| 6,820,743 | B2 * | 11/2004 | Hurley | B65D 81/133 206/427 |
| 7,398,882 | B2 * | 7/2008 | Barrett | B65D 1/30 206/521.15 |
| 2005/0242092 | A1 * | 11/2005 | Sinton | B65D 1/36 220/4.21 |
| 2008/0115413 | A1 * | 5/2008 | Blackmore | A01G 9/0295 47/65.7 |
| 2008/0169216 | A1 * | 7/2008 | Kaltz | B65D 21/0212 206/507 |
| 2011/0174657 | A1 * | 7/2011 | Barnett | B65D 1/24 206/505 |

(Continued)

FOREIGN PATENT DOCUMENTS

CA 2856688 C 7/2014

*Primary Examiner* — Jacob K Ackun

(74) *Attorney, Agent, or Firm* — Greensfelder, Hemker & Gale, P.C.

(57) ABSTRACT

Four embodiments of a tray are disclosed for transporting and storing milk containers and for nesting the trays for their return trip to their origin.

11 Claims, 11 Drawing Sheets

(56) References Cited

U.S. PATENT DOCUMENTS

| | | | | |
|---|---|---|---|---|
| 2012/0223083 | A1* | 9/2012 | Hug | B65D 25/04 220/507 |
| 2014/0102940 | A1* | 4/2014 | McFarlane | B65D 21/0219 206/561 |

* cited by examiner

MILK CRATE

CROSS-REFERENCE TO RELATED APPLICATIONS

This application claims priority to U.S. Provisional Patent Application Ser. No. 62/114,176 filed on Feb. 10, 2015 which is incorporated herein by reference in its entirety and made a part hereof.

FEDERALLY SPONSORED RESEARCH OR DEVELOPMENT

N/A

FIELD OF THE INVENTION

The present invention relates to crates and trays for supporting product during transit, storage, and display and, in particular, trays for supporting bagged milk or plastic/paper containers of milk.

BACKGROUND

Milk is normally delivered to the point of purchase either in plastic containers (bottles) or in plastic bags. Plastic bottles have recently been delivered to wholesale outlets in pallet quantities by using unique bottles and corrugated layer pads. The bottles and pads have been designed to support the weight of the bottles in a stack for delivery. Up to this point, bagged milk has only been able to be shipped in large quantities using metal dollies or shelves that can support the entire product weight. These shelving units are generally bulky and do not collapse well. In addition, the bagged milk tends to display poorly with the individual bags leaning off the shelves and looking disheveled.

SUMMARY OF THE INVENTION

The present invention creates a nestable tray or crate system that supports the weight of the bottled or bagged milk.

The trays condense for return shipping by nesting into one another. The trays also provide complete support for the containers' weight as well as provide for better display customer presentation.

BRIEF DESCRIPTION OF THE DRAWINGS

To understand the present invention, it will now be described by way of example, with reference to the accompanying drawings and attachments in which.

DETAILED DESCRIPTION

Figure 1:
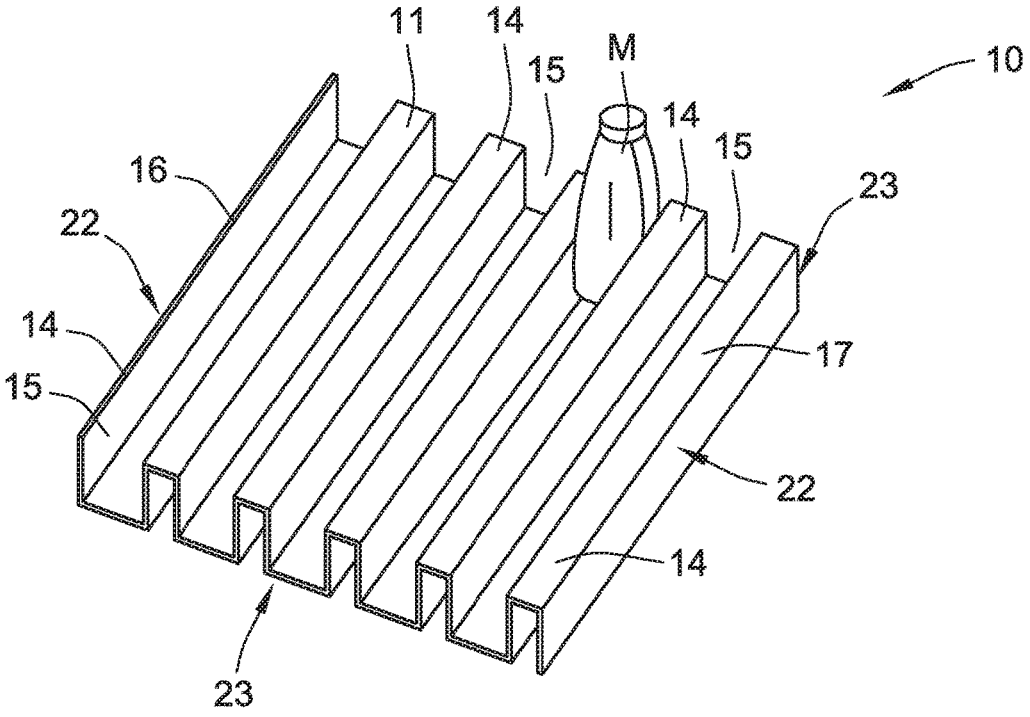
FIG. 1 is a perspective view of a first embodiment of a tray of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

First Embodiment

Figure 3:
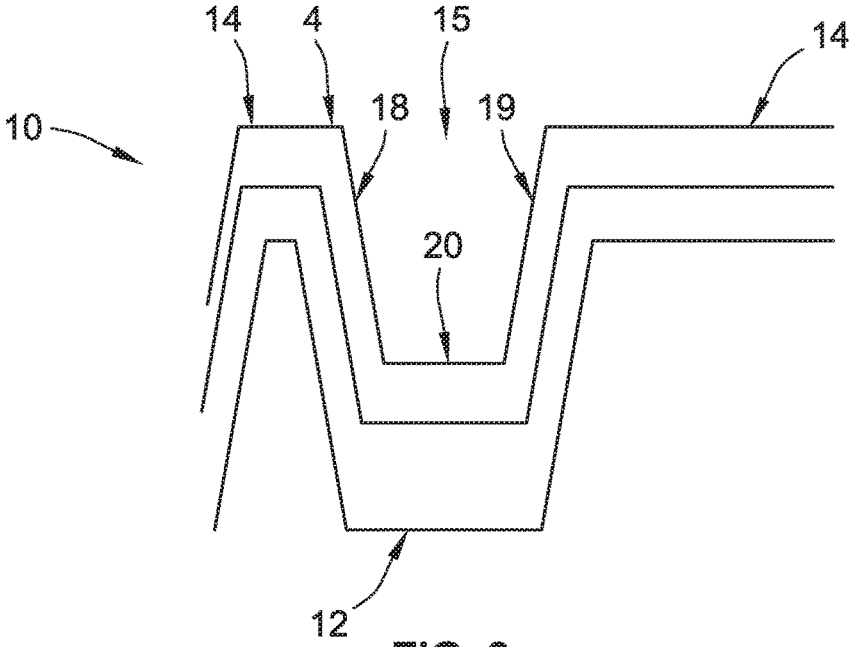
FIG. 3 is a side view of a plurality of the trays of FIG. 1 nesting.

A first embodiment of the tray 10 is shown in FIGS. 1-3. Each tray 10 includes a top surface 11 and bottom surface 12, opposed sides 22, and opposed ends 23. The top surface 11 of the tray 10 has a plurality of parallel flat surfaces 14 and a plurality of troughs each extending between opposed ends 23, one of each of the plurality of troughs 15 being positioned between adjacent flat surfaces 14. Thus, the flats 14 and troughs 15 alternate from one side 22 to the opposed side 22. Each trough 15 includes inwardly tapered or inclined walls 18,19 and a substantially flat seating floor 20. The flat surfaces 16,17 forming the sides 22 of the tray 10 are the same width.

Figure 2A:
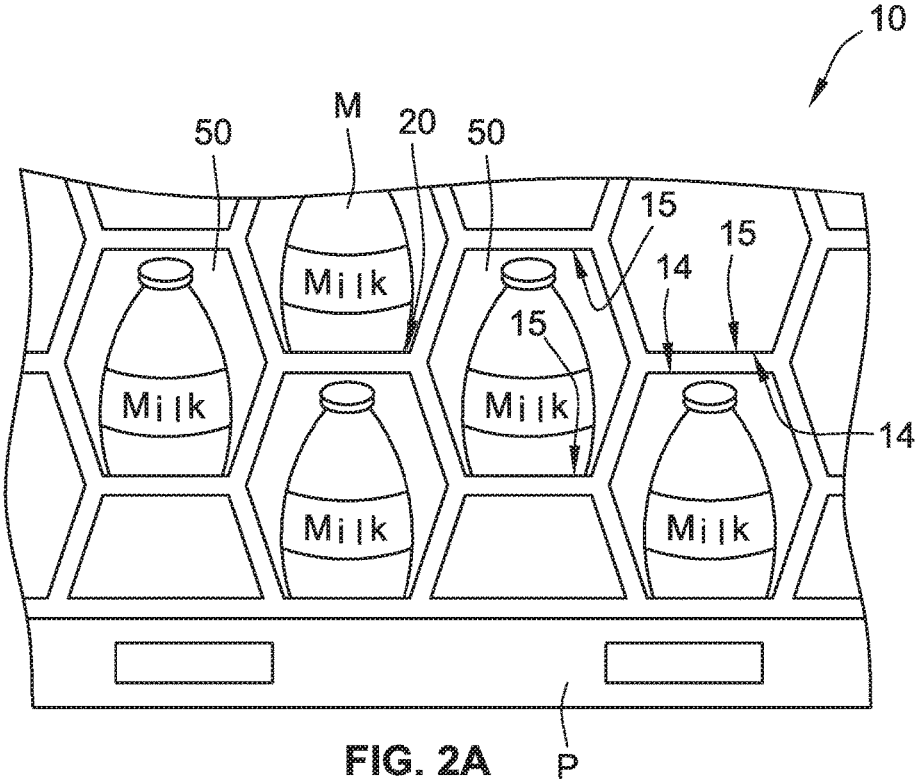
FIG. 2A is a side view of the tray of FIG. 1 in operation.
Figure 2B:
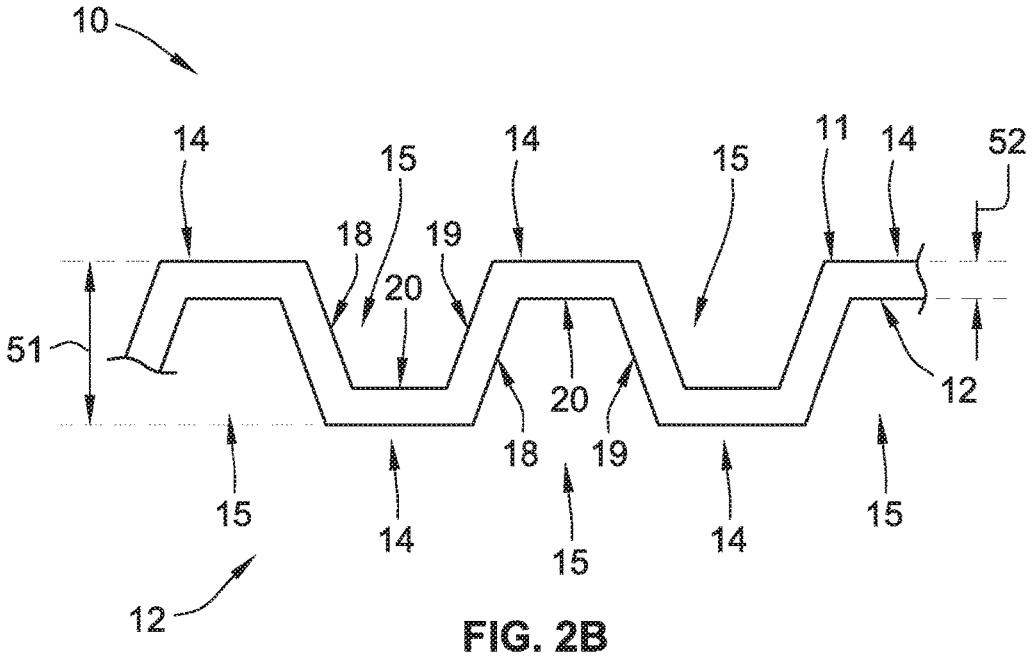
FIG. 2B is a side elevation of a single tray of FIG. 1.

As shown in FIG. 2B, the bottom surface 12 of the tray 10 has the reverse contours of the upper surface 11 of the tray 10. The surfaces 11,12 are complementary of each other. Whereas a trough 15 is in the top surface 11, a flat surface 14 is on the bottom surface 12 and visa versa.

When two trays are stacked in a product storage or shipping position, the troughs and flats of one tray will extend in a direction perpendicular to the troughs and flats of the adjacent tray. That is, the ends of one tray are oriented 180° with respect to the adjacent tray. When adjacent trays have their ends rotated by 180 degrees they are said to be "confronting." In this position, each of the flats 14 and troughs of the bottom surface 12 of the upper tray will extend between the opposed sides 22 of the lower tray crossing over all of the flats and troughs of the upper surface of the lower tray to form a plurality of enclosed, honeycomb chambers or vertical pockets 50 for both seating and protecting the milk M placed therein as shown in FIG. 2A. The milk container has a height less than the height of the pockets so that the milk containers do not form part of the structural support for the stack of trays. The height of the stack of trays in a product storage position is the height of an individual tray multiplied by the number of trays in the stack.

As shown in FIG. 3, when a plurality of trays are stacked in a nested or stored position without product, the flats and troughs of the trays are in alignment and the flats and troughs of the adjacent tray and in surface contact therewith such that the height of the stack of a plurality of n trays is equal to the height 51 (FIG. 2A) of an individual tray plus the thickness 52 of a tray multiplied by n−1.

In one preferred form of the invention, the trays will be fabricated from a polymeric material and formed into the desired shape using standard polymeric forming techniques such as injection molding, thermoforming or the like. The trays can be made from any suitable polymeric materials such as polyolefins, polyamides, polyesters and the like. Preferred polyolefins include homopolymers and copolymers of ethylene, propylene, butene, hexene, octene and combinations of the same. In one preferred form of the invention, the trays are fabricated from a high density polyethylene ("HDPE"), polypropylene ("PP"), or polyethylene ("PE"). The polymeric material can also be foamed to reduce the density of the tray. One preferred tray has a dimension of approximately 98" (end 23) by 40" (side 22). The troughs 15 have a total width of 6". Preferably, the trays are dimensioned to be transported on pallets such as shown in FIG. 2A.

Second Embodiment

The second embodiment of the tray 110 is shown in FIGS. 4-7. FIG. 4A shows the trays holding product M and FIG. 4B shows the trays empty and nested for storage or transport to their place of origin.

Each tray 110 includes a top or upper surface 111 and bottom surface 112, opposed sides 122, and opposed ends 123. The tray 110 has a checkerboard appearance, with a plurality of upper parallel flat surfaces 114 and a plurality of pockets 115. Each pocket 115 includes inwardly tapered or inclined walls 118 and a substantially flat seating floor 120. The underside or bottom surface 112 of the tray 110 has the reverse contours of the upper surface 111 of the tray 110. Again, the bottom surface 112 of the tray 110 is substantially complementary to the top surface 111.

Figures 4A, 4B:
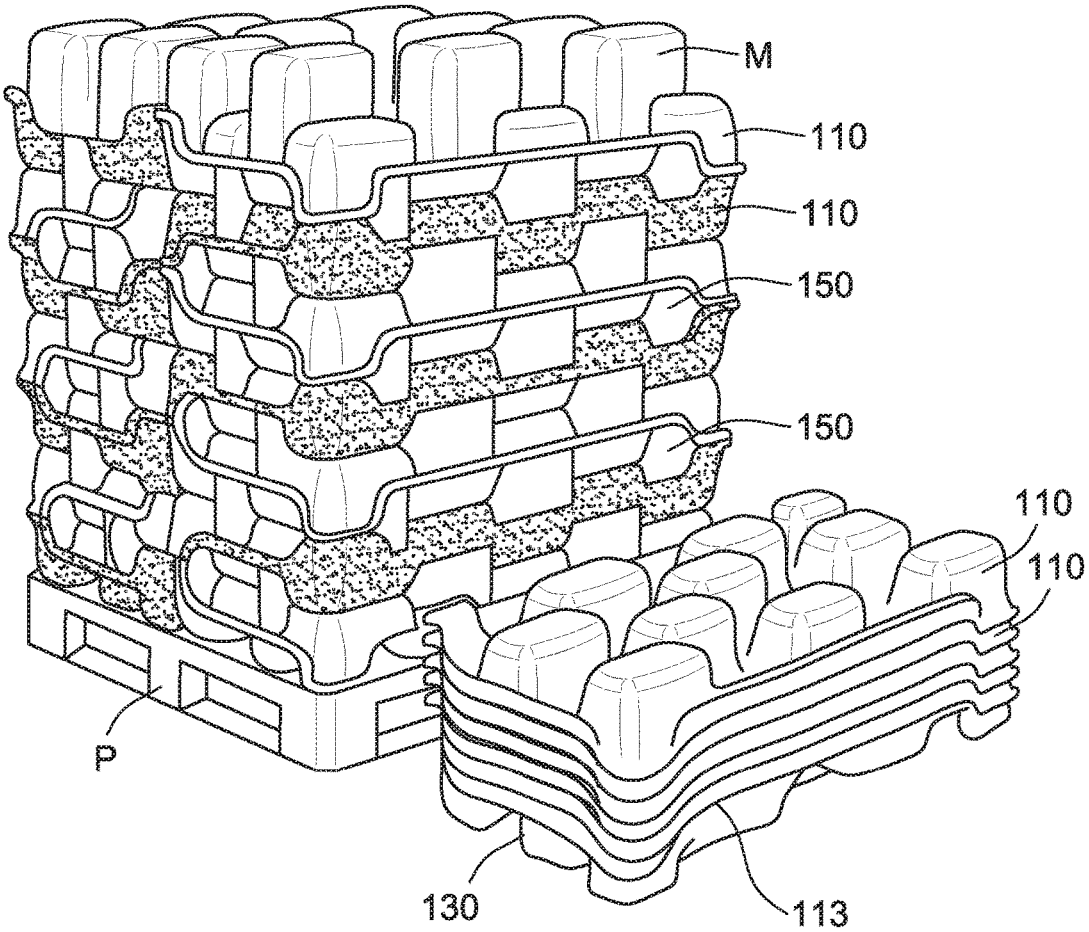
FIG. 4A is a perspective view of a plurality of a second embodiment of a tray stacked and in use.
FIG. 4B is a perspective view of a plurality of the trays of FIG. 4A nesting.
Figure 5:
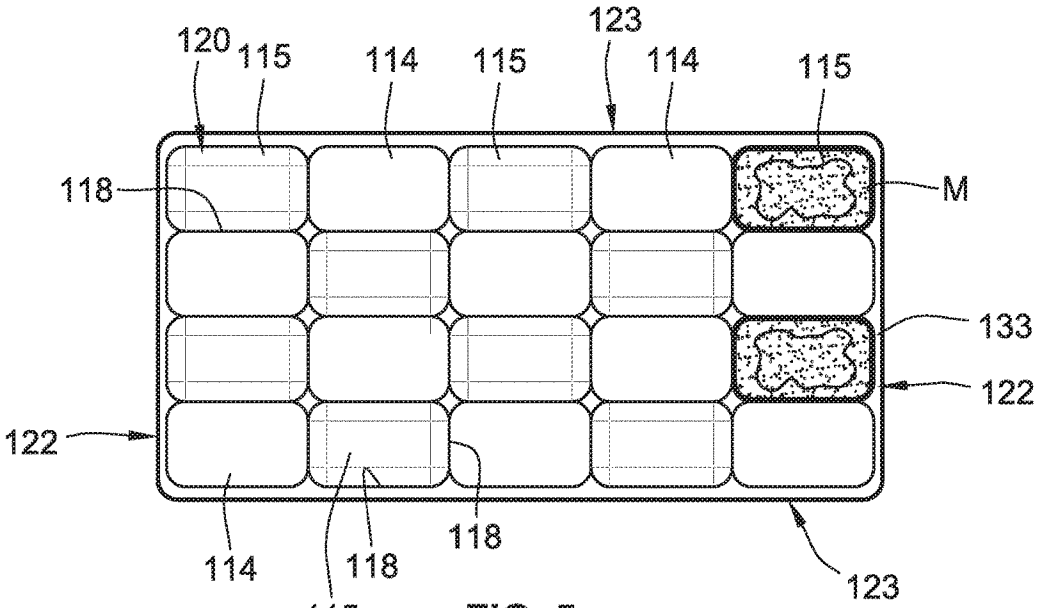
FIG. 5 is a top plan view of the tray of FIG. 4.
Figure 6:
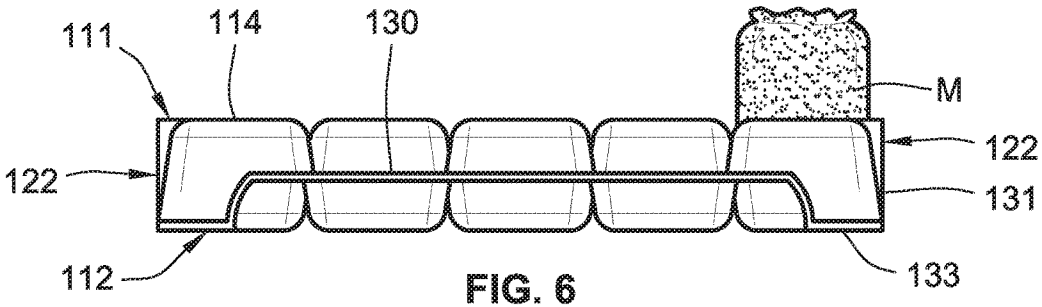
FIG. 6 is a side elevation view of the tray of FIG. 4.

In this embodiment, trays are placed in a product storage position by orienting adjacent trays at 180° of one another. This configuration permits the milk bags M to be placed in the individual pockets 115 (FIG. 4A). When trays are positioned such that one tray confronts the adjacent tray so that flat surfaces 114 of the confronting trays 110 touch one another and the pockets 115 of the confronting trays face and align with one another, they form enclosed spaces or pockets 150 for both seating and protecting the milk M (FIG. 4A). When the trays are stacked in the same direction or orientation, they nest within one another as shown in FIG. 4B.

The tray 110 further includes an outer continuous perimeter rim 133 around the entire tray. The rim forms outer end lips 130 and outer side lips 131 to facilitate gripping and handling of the trays and add strength to the tray and lips.

Again, like the first embodiment, the trays of the second embodiment will be fabricated from a polymeric material and formed into the desired shape using standard polymeric forming techniques such as injection molding, thermoforming or the like. The trays can be made from any suitable polymeric materials such as polyolefins, polyamides, polyesters and the like. Preferred polyolefins include homopolymers and copolymers of ethylene, propylene, butene, hexene, octene and combinations of the same. In one preferred form of the invention, the trays are fabricated from a high density polyethylene ("HDPE"), polypropylene ("PP"), or polyethylene ("PE"). The polymeric material can also be foamed to reduce the density of the tray. One preferred tray has a dimension of approximately 98" (end 23) by 40" (side 22). The troughs 15 have a total width of 6". The tray 110 is approximately 20" (end 123) by 48" (side 122). The pockets 115 have a width of 9.2" and a depth of 4.6". The tray has a thickness of 6" with the lip 130 being approximately 3.1" from the top surface 111. This permits the storage and transportation of 10 milk bags M per layer.

Figure 7:
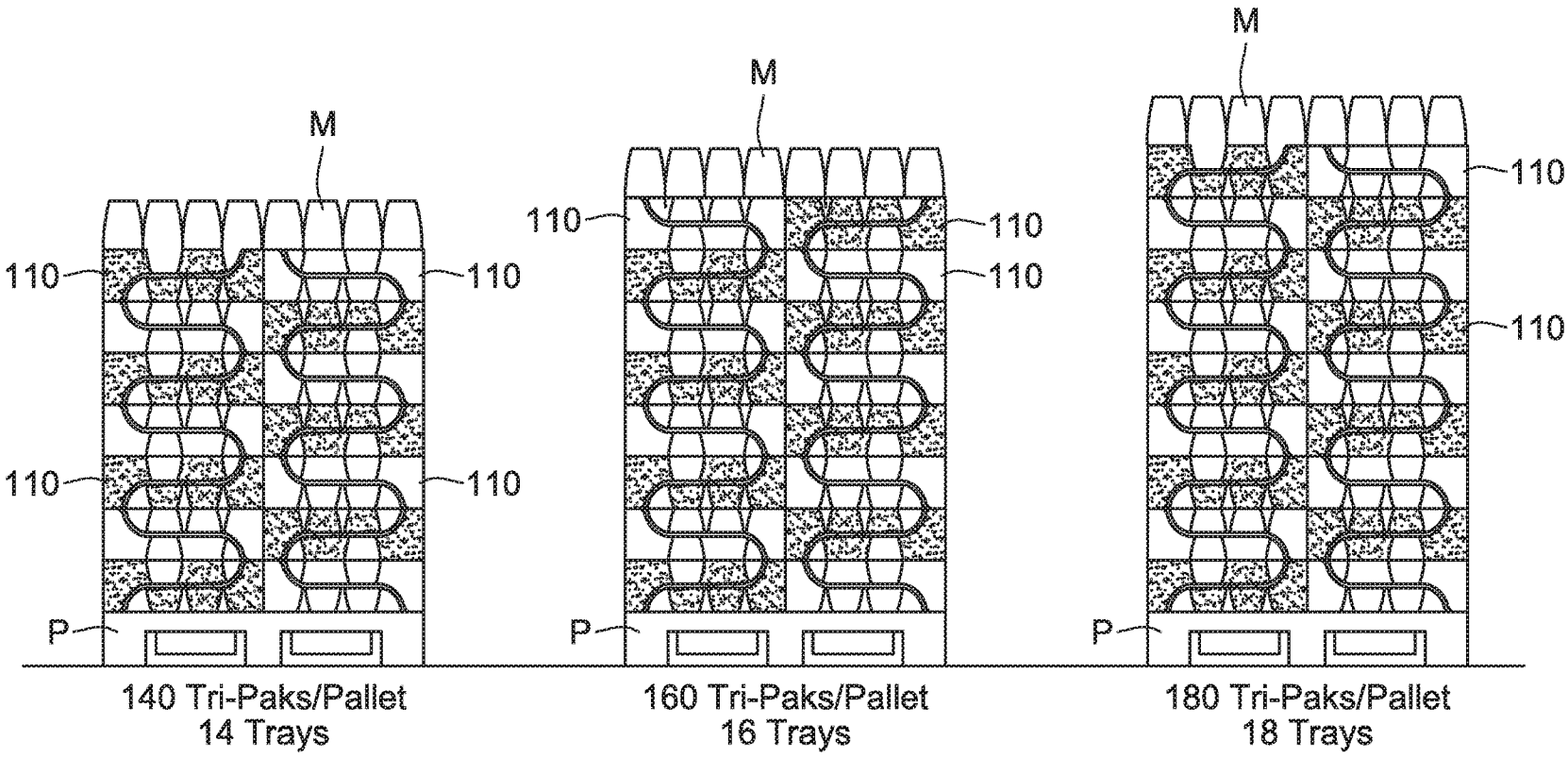
FIG. 7 is a view showing three separate stacks of the trays of FIG. 4 with product.

The stacked, confronting trays are sized so they can be transported and stored on pallets P as shown in FIG. 7.

Third Embodiment

The third embodiment of the tray 210 is shown in FIGS. 8-11. FIG. 8A shows the trays 210 in the product storage position with product therein and in use and FIG. 8B shows the trays 210 empty and nested for storage or transport to their place of origin. In the product storage position, adjacent trays are rotated 180° from one another, and in the nested position the trays have their ends in alignment or in the same orientation.

Each tray 210 includes a top surface 211 and bottom surface 212, opposed sides 222, and opposed ends 223. The tray 210 has a plurality of dividers 214 and a plurality of pockets 215 with a substantially flat seating floor 220.

Figures 8A, 8B:
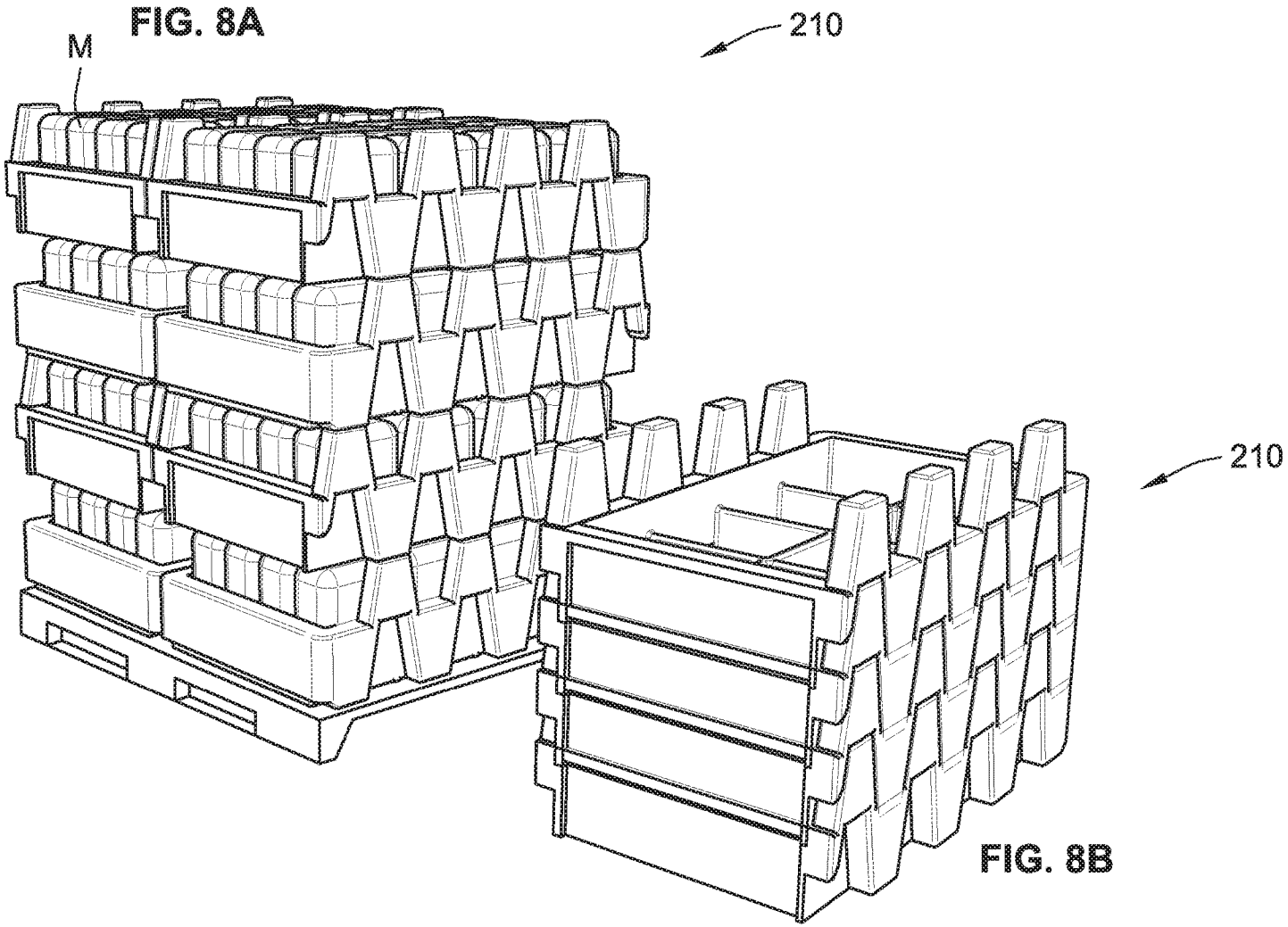
FIG. 8A is a perspective view of a plurality of trays of a third embodiment stacked and in use.
FIG. 8B is a perspective view of a plurality of the trays of FIG. 8A nesting.
Figure 9:
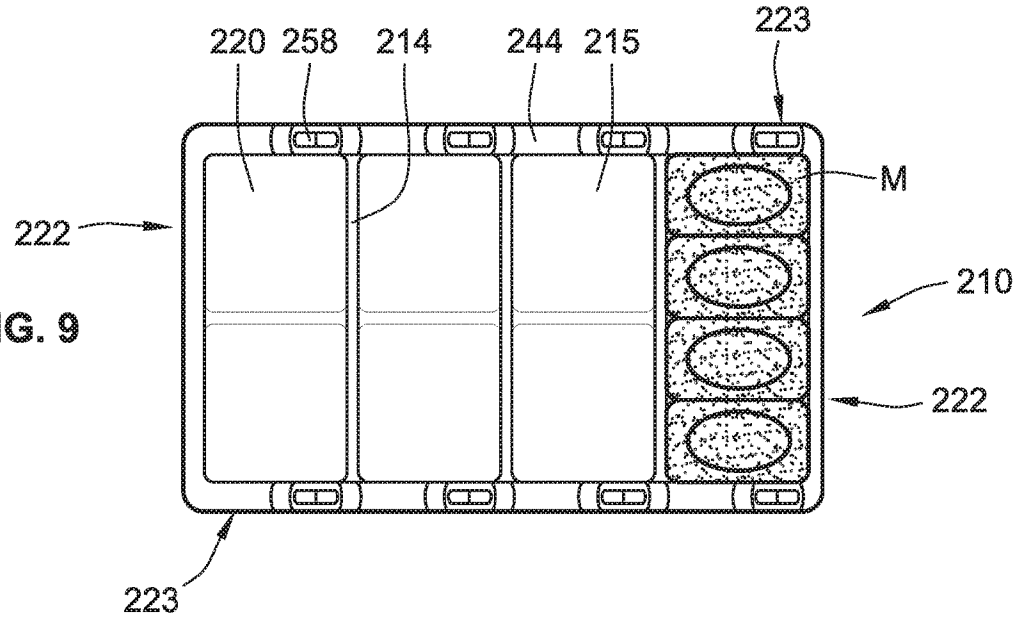
FIG. 9 is a top plan view of the tray of FIG. 8A.
Figure 10:
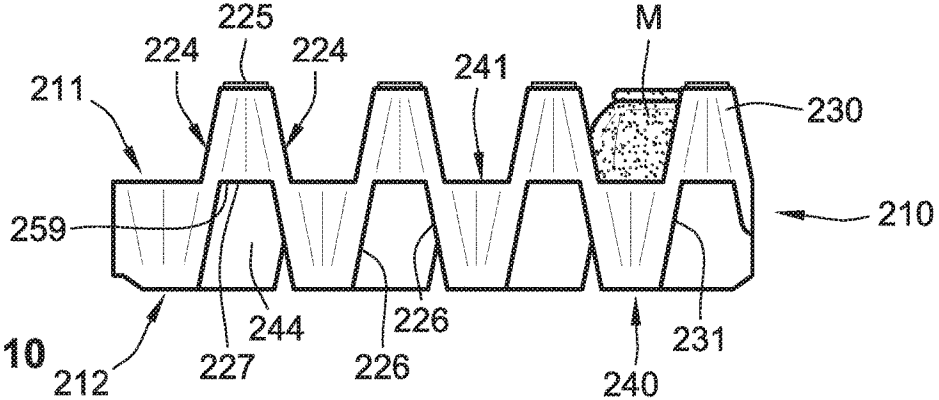
FIG. 10 is a side elevation view of the tray of FIG. 8A.

The ends 223 of the tray 210 include a plurality of towers, or trapezoidal structures thereon having upwardly projecting towers 230 and downwardly projecting walls 231. The towers 230 have angular edges or surfaces 224 and a flat top 225 edge while the projecting walls 231 have angular edges 226 and a flat edge 240. In addition, a channel 244 for seating the tower 230 is formed in the tray by the edges 226 that terminates in a flat seat 227. The trapezoidal structures are offset so that the edges and flat portions mate or communicate with one another differently when stacked and nested. FIG. 8A shows the trays in a product storage position with adjacent trays being positioned with their ends rotated by 180° from one another. FIG. 8B shows the trays in a nested position with the ends of the trays in alignment or in the same orientation.

The towers 230 seat or are interconnected to the channels 244. Interconnecting knobs 258 are formed in the upper surfaces or flat top 225 of the towers 230 for fitting within corresponding indents 259 or openings in the flat top 244. This prevents sliding between the trays once aligned and seated.

The tray 210 is not symmetrical. As a result, the trays seat with each other or cooperate with one another differently when adjacent trays face the same way or face different ways (turned 180 degrees). This configuration permits the milk bags M to be placed and stored in the pockets 215 while the towers protect them and support the tray above them when every other tray is rotated 180 degrees (FIG. 8A).

Again, as with the prior embodiment, the trays 210 of the third embodiment will be fabricated from a polymeric material and formed into the desired shape using standard polymeric forming techniques such as injection molding, thermoforming or the like. The trays can be made from any suitable polymeric materials such as polyolefins, polyamides, polyesters and the like. Preferred polyolefins include homopolymers and copolymers of ethylene, propylene, butene, hexene, octene and combinations of the same. In one preferred form of the invention, the trays are fabricated from a high density polyethylene ("HDPE"), polypropylene ("PP"), or polyethylene ("PE"). The polymeric material can also be foamed to reduce the density of the tray. The tray's dimensions are shown in the Figures. The tray is 24" by 40" with the pockets being 9.88" by 9.14". The tray has a height of approximately 6.1" with the towers having a height of roughly 12.2".

Figure 11:
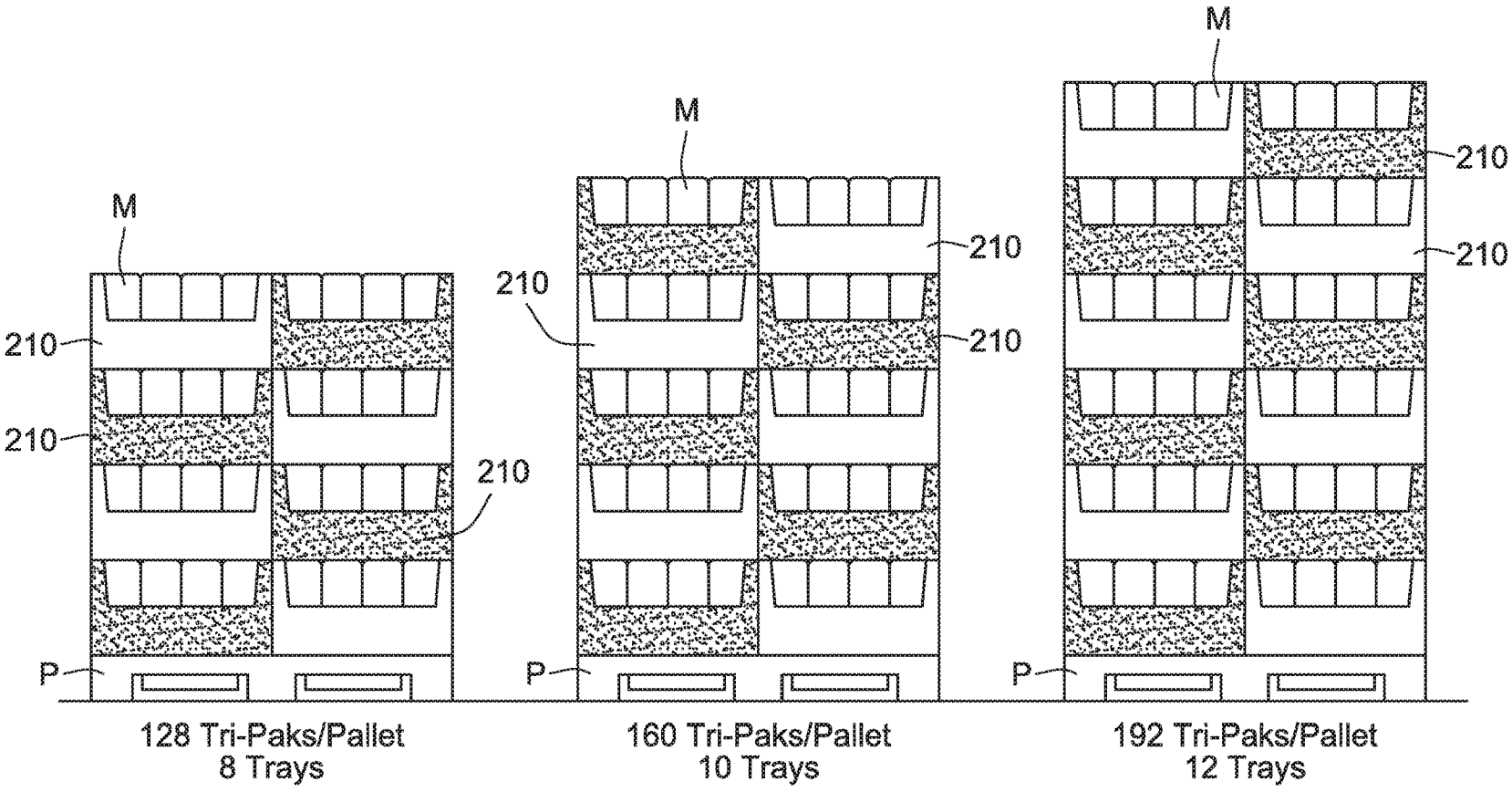
FIG. 11 is a view showing three separate stacks of the trays of FIG. 8A with product.

The stacked, confronting trays are sized so they can be transported and stored on pallets P as shown in FIG. 11.

Fourth Embodiment

The fourth embodiment of the tray 310 is shown in FIGS. 12-15. FIG. 12A shows the trays in a product storage position holding product M and FIG. 12B shows the trays empty and nested for storage or transport back to their place of origin.

Each tray 310 includes a top surface 311 and bottom surface 312, opposed sides 322, and opposed ends 323. The tray 310 has a plurality of parallel flat surfaces 314*a* and dividers 314*b* and a plurality of pockets 315 with a substantially flat seating floor 320. The underside or bottom 312 of the tray 310 can substantially have the reverse contours of the upper side 311, with or without dividers 314*b*, of the tray 310.

Figures 12A, 12B:
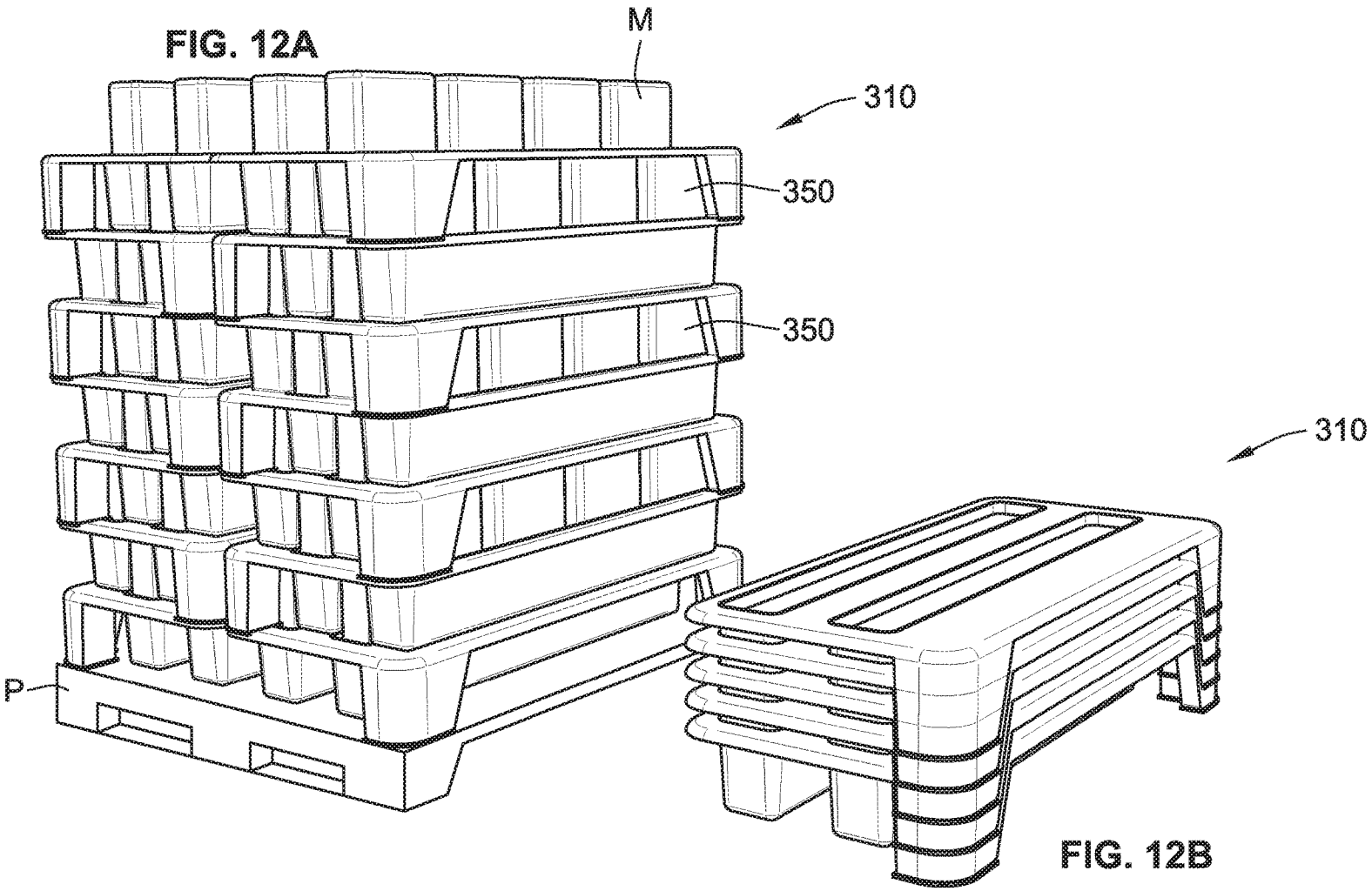
FIG. 12A is a perspective view of a plurality of a fourth embodiment of a tray stacked and in use.
FIG. 12B is a perspective view of a plurality of the trays of FIG. 12A nesting.
Figure 13:
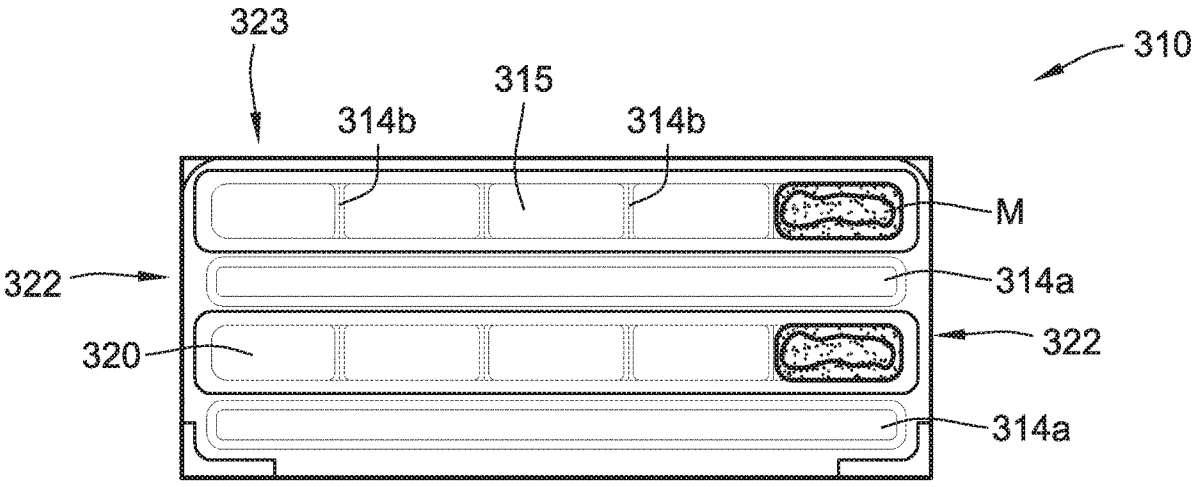
FIG. 13 is a top plan view of the tray of FIG. 12A.
Figure 14:
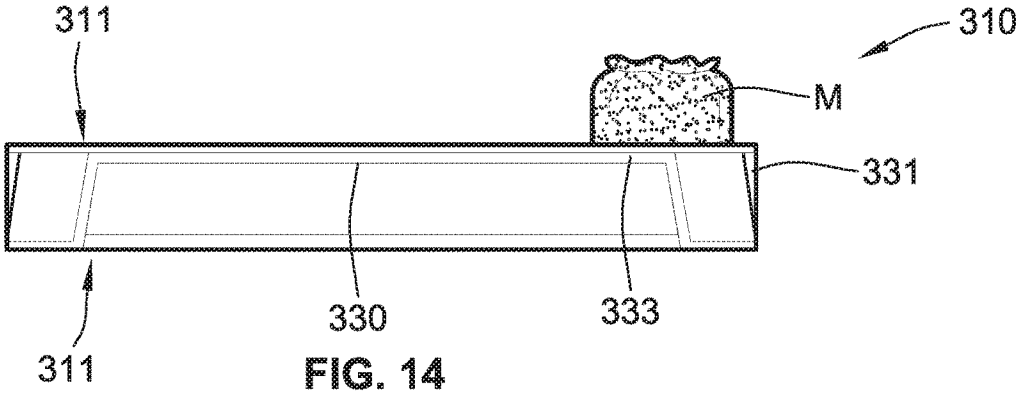
FIG. 14 is a side elevation view of the tray of FIG. 12A.

In the product storage position, adjacent trays are rotated 180° from one another (FIG. 12A). When every other tray is rotated 180 degrees, the flat surfaces 314*a* of the lower surface 312 of the upper tray contacts the flat surface 314*a* of the upper surface 311 lower tray and the pockets 315 of the upper tray face and are aligned with the pockets 315 of the lower tray to form enclosed spaces or pockets 315 for both seating and protecting the milk M.

The tray 310 further includes an outer continuous perimeter rim 333 around the entire tray. The rim 333 forms outer end lips 330 and outer side lips 331 to facilitate gripping and handling of the trays and add strength to the tray and the lips.

As in the other embodiments, the trays of the fourth embodiment will be fabricated from a polymeric material and formed into the desired shape using standard polymeric forming techniques such as injection molding, thermoforming or the like. The trays can be made from any suitable polymeric materials such as polyolefins, polyamides, polyesters and the like. Preferred polyolefins include homopolymers and copolymers of ethylene, propylene, butene, hexene, octene and combinations of the same. In one preferred form of the invention, the trays are fabricated from a high density polyethylene ("HDPE"), polypropylene ("PP"), or polyethylene ("PE"). In one preferred form of the invention, the tray is 20" by 48" with the pockets being 4.4" by 9.1". The tray has a height of the tray is 6.5".

Figure 15:
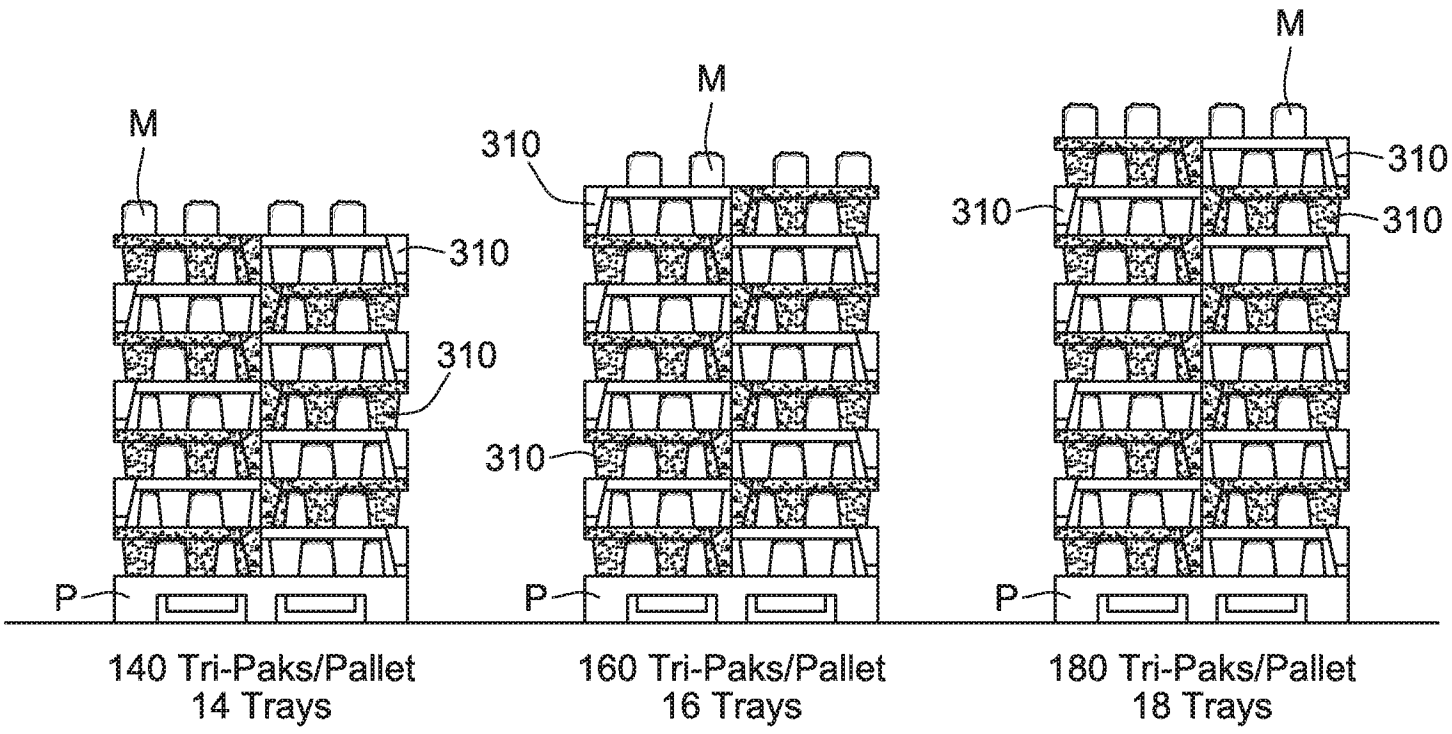
FIG. 15 is a view showing three separate stacks of the trays of FIG. 12A with product.

The stacked, confronting trays are sized so they can be transported and stored on pallets P as shown in FIG. 15.

The terms "first," "second," "upper," "lower," "top," "bottom," "above," below," etc. are used for illustrative purposes to associate relative positioning of elements to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

I claim:

1. A tray for use with a similar tray to form a tray stack for supporting individual containers, the tray having a first end and a second end opposed to the first end, a plurality of troughs extending between the first end and the second end, a plurality of raised flat surfaces extending between the first end and the second end and being spaced from the troughs along an axis of rotation extending perpendicular to the plurality of flat surfaces, one of each of the plurality of troughs being positioned between one of each of the plurality of flat surfaces, each trough of the plurality of troughs has a generally U-shape facing in a first direction, each of the plurality of flat surfaces has a generally U-shape facing in a second direction opposed to the first direction, the plurality of troughs nest within a plurality of troughs of a similar tray when in a first orientation, and the plurality of troughs contact a plurality of flat surfaces of a similar tray in a second orientation to form chambers for seating the containers therebetween, the second orientation being rotated 90° about the axis of rotation with respect to the first orientation.

2. The tray of claim 1 wherein the chambers have a height greater than a height of the containers.

3. The tray of claim 2 wherein the tray is fabricated from a polymeric material.

4. The tray of claim 3 wherein the polymeric material is selected from the group consisting of polyolefins, polyamides, and polyesters.

5. The tray of claim 4 wherein the polyolefin includes homopolymers and copolymers of ethylene, propylene, butene, hexene, octene and combinations of the same.

6. The tray of claim 4 wherein the polyolefins include high density polyethylene, polypropylene, and polyethylene.

7. The tray of claim 3 wherein the polymeric material is foamed.

8. The tray of claim 1 wherein each trough of the plurality of troughs has a continuous planar surface from the first end to the second end.

9. The tray of claim 8 wherein each flat surface of the plurality of flat surfaces has a continuous planar surface from the first end to the second end.

10. The tray of claim 1 wherein there is an equal number of troughs and flat surfaces X and $X^2$ chambers.

11. The tray of claim 10 wherein there are five troughs, five flat surfaces, and twenty-five chambers.

* * * * *